US005783529A

United States Patent [19]

Kalhan et al.

[11] Patent Number: 5,783,529

[45] Date of Patent: Jul. 21, 1998

[54] RHAMSAN GUM AS MIST SUPPRESSANT IN METAL WORKING FLUIDS

[75] Inventors: Sanjay Kalhan, Willoughby Hills; Edward A. Collins, Avon Lake, both of Ohio

[73] Assignee: The Lubrizol Corporation, Wickliffe, Ohio

[21] Appl. No.: 957,296

[22] Filed: Oct. 24, 1997

[51] Int. Cl.[6] ..... C10M 173/00

[52] U.S. Cl. ..... 508/216; 508/583; 72/42

[58] Field of Search ..... 508/216, 583; 72/42

[56] References Cited

U.S. PATENT DOCUMENTS

| | | | |
|---|---|---|---|
| 3,833,502 | 9/1974 | Leary et al. | 252/49.5 |
| 4,432,881 | 2/1984 | Evani | 252/8.5 |
| 4,493,777 | 1/1985 | Snyder, Jr. et al. | 252/49.3 |
| 4,770,814 | 9/1988 | Rose et al. | 252/315.4 |
| 4,781,847 | 11/1988 | Weitz | 508/216 |
| 4,880,565 | 11/1989 | Rose et al. | 252/355 |
| 5,273,767 | 12/1993 | Burgum | 426/240 |
| 5,362,312 | 11/1994 | Skaggs et al. | 106/189 |
| 5,492,639 | 2/1996 | Schneider et al. | 508/126 |
| 5,496,479 | 3/1996 | Uideau et al. | 508/216 |
| 5,556,453 | 9/1996 | La Brash et al. | 106/205.01 |
| 5,633,222 | 5/1977 | Sköld et al. | 508/562 |
| 5,691,282 | 11/1997 | Periard et al. | 508/113 |

*Primary Examiner*—Jacqueline V. Howard
*Attorney, Agent, or Firm*—David M. Shold

[57] ABSTRACT

Metal working compositions which contain rhamsan gum as a mist suppressant exhibit good anti-mist performance and good retention of performance in the presence of prolonged times of shearing.

23 Claims, No Drawings

RHAMSAN GUM AS MIST SUPPRESSANT IN METAL WORKING FLUIDS

BACKGROUND OF THE INVENTION

The present invention relates to a composition for reducing mist formation from lubricants in applications generating shear, such as metal working and cutting operations.

Anti-misting additives reduce the misting of machine fluids at the source by stabilizing them against droplet break-up during the shearing conditions which occur during metal working and other high shear operations. Cutting fluids can be oil-in-water emulsions, including an oil, an emulsifier, and a mist-suppressing agent. Cutting operations often involve a work piece, often of metal, but optionally of another material such as a ceramic, which rotates at a relatively high speed and a cutting tool, both of which are lubricated by a cutting fluid, also known, depending on the application, as a metal working fluid. Under these high shear conditions, the metal working fluid is frequently thrown from the surface of the metal in the form of droplets which may be small enough to be classified as a mist. Mist formation is considered undesirable because it represents a loss of the cutting fluid, and the cutting fluid mist can be considered a contaminant in the air around the cutting machine. Mist formation can also occur under conditions which are not normally associated with high shear operations. Simple splashing of liquids, under some circumstances, can result in undesirable mist formation.

Various materials have been used as anti-misting additives. High molecular weight poly(ethylene oxide) is commonly used in this application. A typical polymer of this type is POLYOX®, available from Union Carbide, typically having a molecular weight of 1 to 2 million.

U.S. Pat. No. 5,362,312, Skaggs et al., Nov. 8, 1994, discloses a liquid carrier fluid to suspend and deliver water soluble polymers or gums which act to adjust the rheological properties of the aqueous system. The polymeric fluid composition can be used in the agricultural, fire-fighting, metal-working, mining and oil field industries. Water-soluble polysaccharides include xanthan gum, gellan gum, algin, carrageenan, guar, hydroxypropyl guar, and certain cellulosics. Viscosifying polysaccharides include gellan gum, xanthan gum, rhamsan gum, welan gum or glycol-compatible welan gum, and various sulfated polysaccharides.

U.S. Pat. No. 5,556,453, La Brash et al., Sep. 17, 1996, discloses addition of xanthan gum to aqueous dispersions of colloidal silica containing non-skid components for improved spraying. Including a small amount of xanthan gum (e.g., 0.15 to 1 part per 100 parts) decreases the misting problems associated with such non-skid compositions.

U.S. Pat. No. 3,833,502, Leary et al., Sep. 3, 1974, discloses a method for improving the adherence of metal-working coolants to metal surfaces by incorporating with such coolants small amounts of water-soluble polymers. Organic polymeric coagulants of vegetable and cellulosic origin may also be used, including water-soluble or dispersible starches, starch derivatives, dextrans, phosphated starch, Gum Ghatti, Jaar, Locust Bean Gum, and carboxy methylcellulose.

SUMMARY OF THE INVENTION

The present invention provides a method for lubricating a workpiece in an operation which is susceptible to formation of lubricant mist, comprising: supplying to said workpiece a lubricating composition comprising (a) water and (b) a water-soluble heteropolysaccharide having a tetrasaccharide repeating unit which contains a carboxylic group and a saccharide substituent at carbon 6 of each 3-linked backbone glucose, in an amount suitable to reduce mist formation from said composition.

Otherwise stated, the invention provides a method for lubricating a workpiece in an operation which is susceptible to formation of lubricant mist, comprising: supplying to said workpiece a lubricating composition comprising (a) water and (b) an amount of rhamsan gum suitable to reduce mist formation from said composition.

More generally, the present invention provides a method for reducing mist formation in a high shear aqueous system which involves application of an aqueous lubricating composition in said high shear system, comprising: including in said aqueous composition a mist reducing amount of rhamsan gum.

DETAILED DESCRIPTION OF THE INVENTION

Various preferred features and embodiments will be described below by way of non-limiting illustration.

The metal working fluids of the present invention include aqueous based, oil-free compositions. In their simplest form, these compositions include water and an antimisting gum.

Gums, also referred to as plant gums or natural gums, are substances which generally dissolve in water, but not in organic solvents, to give mucilaginous solutions or gels. They are typically at least partially in the form of a salt and preferably have a number average molecular weight of $5\times10^5$ to $5\times10^6$. Typical gums include gum arabic, karaya gum, guar gum, mesquite gum, damson gum, gum tragacanth, agar, algin, carrageenan, gum ghatti, seed gums, locust bean gum, psyllium seed gum, quince seed gum, lard gum, pectin, dextran, tamarind gum, xanthan gum, and rhamsan gum, which is particularly useful for the purposes of the present invention.

Rhamsan gum is a microbial polysaccharide produced by Alicaligenes strain (ATCCC 31961) and is commercially available from, e.g., Kelco Division of Merck & Co., Inc., San Diego, Calif. It has been identified as a water-soluble heteropolysaccharide having a tetrasaccharide repeating unit which contains a carboxylic group and a saccharide substituent at carbon 6 of each 3-linked backbone glucose. The detailed chemical structure and composition of certain gums may be imperfectly known. The efficacy of rhamsan gum in the present invention, therefore, is not dependent upon the correctness or accuracy of identification of the details of its chemical structure. This identification is provided not as a limitation, but for the purpose of alternative definition of the material involved and in order to provide a basis for identifying other materials which will have a generally equivalent structure and will thus be included within the scope of the invention, regardless of their source. Should further investigation indicate that rhamsan gum in fact has a different structure, nonetheless rhamsan gum is included within the scope of the invention.

It is desirable to include the rhamsan gum at a level which is effective to suppress mist. However, even with recovery of used metal working fluids some is lost in use and the inclusion of the antimisting gum is an expense. Accordingly, it is also desirable to use the antimisting gum at the lower levels of its effective concentration range. Many factors affect the level of gum required to achieve an antimisting effect. The shape of the tool and the work piece, the shear level in the particular application, and the rate of movement of the work-piece all influence the amount of mist suppression required. The antimisting gum is used in a concentration range of 50 to 5,000 parts per million, preferably 200 to 1,000 parts per million, based upon the total weight of the composition.

In addition to the antimisting gum, the aqueous metal working fluids may contain additives to improve the properties of the composition. These additives include anti-foam agents, metal deactivators, corrosion inhibitors, and antimicrobial, anticorrosion, extreme pressure, antiwear, antifriction, antirust, and lubricity agents. Such materials are well known to those skilled in the art. Other materials which can be included are those materials which modify the nature of the rhamsan gum itself. Plasticizers can be used, among which ethylene glycol is one example. Coupling agents, that is, compatibilizing agents or cosolvents, of which ethylene glycol is also an example, can also be included.

Typical anti-friction agents include overbased sulfonates, sulfurized olefins, chlorinated paraffins and olefins, sulfurized ester olefins, amine terminated polyglycols, and sodium dioctyl phosphate salts. Useful anti-foam agents include: alkyl polymethacrylates, and polymethylsiloxanes. Metal deactivators include materials such as tolyltriazoles. Corrosion inhibitors include carboxylic/boric acid diamine salts, carboxylic acid amine salts, alkanol amines, alkanol amine borates and the like.

The fluids of the present invention can comprise simple solutions of rhamsan gum, optionally with the other aforementioned components, dissolved in water or in another suitable fluid. The aqueous metal working fluids can contain other additives to improve the properties of the composition, including anti-foam agents, metal deactivators, corrosion inhibitors, pH adjusting agents, perfumes, and antimicrobial, anticorrosion, extreme pressure, antiwear, antifriction, lubricating, viscosity-adjusting, solubility-improving, and antirust agents. Typical anti-friction agents include overbased sulfonates, sulfurized olefins, chlorinated paraffins and olefins, sulfurized ester olefins, amine terminated polyglycols, and sodium dioctyl phosphate salts. Useful anti-foam agents include alkyl polymethacrylates and polymethylsiloxanes. Metal deactivators include materials such as tolyltriazoles. Corrosion inhibitors include carboxylic/boric acid diamine salts, carboxylic acid amine salts, alkanol amines, alkanol amine borates and the like. Solubility-improving agents include glycols, such as hexylene glycol; alcohols, such as tridecanol and oleyl alcohol; and glycol ethers, such as butyldioxitol and butyltrioxitol. Such materials are well known to those skilled in the art. Other components which can also be dissolved in an aqueous lubricants of this type, in order to assist the lubricant properties, include synthetic esters, salts such as phosphite esters, amine carboxylates, and ethoxylated glycols.

More commonly, however, the fluids of the present invention are oil-in-water emulsions. The emulsion compositions contain the same type and amounts of antimisting gum as the purely aqueous compositions discussed above. The compositions may also contain the property improving additives which have been used in the purely aqueous fluids noted above.

The oils used in the emulsion compositions may include petroleum oils, such as oils of lubricating viscosity, crude oils, diesel oils, mineral seal oils, kerosene's, fuel oils, white oils, and aromatic oils. Liquid oils include natural lubricating oils, such as animal oils, vegetable oils, mineral lubricating oils, solvent or acid treated mineral oils, oils derived from coal or shale, and synthetic oils. Synthetic oils include hydrocarbon oils and halo-substituted hydrocarbon oils such as polymerized and interpolymerized olefins, for example polybutylenes, polypropylenes, propylene-isobutylene copolymers, chlorinated polybutylenes, poly(1-hexenes), poly(1-octenes), poly(1-decenes); alkyl benzenes, such as dodecylbenzenes, tetradecylbenzenes, dinonylbenzenes, di-(2-ethylhexyl)benzenes; polyphenyls such as biphenyls, terphenyls, and alkylated polyphenyls; and alkylated diphenyl ethers and alkylated diphenyl sulfides and derivatives, analogs and homologs thereof.

Alkylene oxide polymers and derivatives thereof where terminal hydroxy groups have been modified by esterification, etherification etc. constitute another class of synthetic oils. These are exemplified by polyoxyalkylene polymers prepared by the polymerization of ethylene oxide or propylene oxide, the alkyl and aryl ethers of these polyoxyalkylene polymers such as methyl-polyisopropylene glycol ethers, diphenyl and diethyl ethers of polyethylene glycol; and mono and polycarboxylic esters thereof, for example, the acetic esters, mixed $C_3$–$C_8$, fatty acid esters and $C_{13}$ oxo diester of tetraethylene glycol. Simple aliphatic ethers may be used as synthetic oils, such as, dioctyl ether, didecyl ether, di(2-ethylhexyl) ether.

Another suitable class of synthetic oils comprises the esters of fatty acids such as ethyl oleate, lauryl hexanoate, and decyl palmitate. The esters of dicarboxylic acids such as phthalic acid, succinic acid, maleic acid, azelaic acid, sebacic acid, fumaric acid, adipic acid, linoleic acid dimer, malonic acid, alkyl malonic acids, alkenyl malonic acids with a variety of alcohols such as butyl alcohol, hexyl alcohol, dodecyl alcohol, 2-ethylhexyl alcohol, ethylene glycol, diethylene glycol monoethyl ether, propylene glycol. Specific examples of these esters include dibutyl adipate, di(2-ethylhexyl) sebacate, di-n-hexyl fumarate, dioctyl sebacate, diisoctyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethyl-hexanoic acid.

The weight ratio of oil to water in the emulsion can typically vary from 1:1 to 1:400, preferably 1:2 to 1:200, depending in part on the application at hand. Compositions for using in drawing or forming applications can employ oil:water ratios of 1:1 to 1:2. Compositions for grinding lubricants can employ oil:water ratios of 1:50 to 1:100. For many common applications, ratios of 1:9 to 1:50 are suitable.

Any oil-in-water emulsifier may be used to prepare the emulsions of the present invention. Emulsifiers may be single materials or may be mixtures of surfactants. Typical emulsifiers include alkali metal sulfonates such as sodium sulfonates, and carboxylates, salts derived from the reaction product of carboxylic acylating agents with amines and hydroxylamines, polyols, polyether glycols, polyethers, and polyesters and the like. Sodium sulfonates are preferred for many applications. *The Kirk-Othmer Encyclopedia of Chemical Technology* (3rd. Edition V. 8 pp. 900–930) provides a good discussion of emulsions and provides a list of emulsifiers useful in preparation of oil-in-water emulsions.

The emulsions prepared according the present invention can also be in the form of microemulsions, assuming the appropriate emulsifiers and emulsification conditions are selected. Microemulsions are specially stabilized emulsion, which may form spontaneously, in which the dispersed droplets are extremely small, typically 10 nm to less than 100 nm. Because of the small droplet size, microemulsions are thermodynamically stable and are typically transparent or nearly so. Microemulsions can be of the water-in-oil or oil-in-water types. Microemulsions are typically formed with high levels of surfactants, such as roughly an order of magnitude greater than the levels typically used for preparation of ordinary emulsions. Moreover, co-surfactants such as a short-chain alcohol such as cetyl alcohol or hexanol are frequently required for formation of microemulsions.

The compositions of the present invention can be used to reduce mist formation in a variety of applications, including in particular those in which high shear is generated. Such applications will typically generate shear of 1,000 $sec^{-1}$ or above, often 10,000 $sec^{-1}$ and above, or even 100,000 $sec^{-1}$ and above. The antimist performance of rhamsan gum is superior to that of many other materials in that the antimist efficiency is very well retained even after extended exposure to shear. This means that compositions based on rhamsan gum will exhibit initially good performance and will retain their usefulness for longer periods of time than will compositions based on many other materials such as other natural gums or synthetic polymers such as polyethylene oxide.

It is known that some of the materials described above may interact in the final formulation, so that the components of the final formulation may be different from those that are initially added. For instance, metal ions (of, e.g., a detergent) can migrate to other acidic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

EXAMPLES

A partially enclosed Boyar Schulz™ surface grinder is used to evaluate the mist suppression performance of additives in a machining application. The grinder is used to machine 1018 steel at 3000 r.p.m. with recirculating coolant being fed to the workpiece/grinding wheel interface from a 9.5 L (2.5 gallon) capacity reservoir. A gear pump is used to recirculate the coolant at 9.5 L/min (2.5 gal/min) at 27 kPa (4 p.s.i.). The grinding wheel and workpiece are enclosed by a transparent plastic enclosure, volume 0.034 $m^3$ (1.2 $ft^3$) to capture and localize the mists produced during grinding.

A portable, real-time DataRAM™ aerosol monitor (from MIE Instruments Inc. of Bedford, Mass.) is used to continuously quantify the airborne mist levels for up to 8 hours of grinding. The aerosol monitor is a nephelometric monitor used to measure airborne particle concentration by sensing the amount of light scattered by the population of particles passing through a sampling volume. During its operation, a discrete amount of air volume (about 2 L/min) is illuminated by a pulsed light emitting diode with a narrow band at 880 nm. The concentration of airborne particulates is measured based on the response of a silicon detector hybrid amplifier unit to the forward scattered light intensity.

The air sampling in the grinder experiment is done under stagnant conditions so as to exaggerate and maximize the mist concentrations in an enclosed space, with no ventilation. The sampling probe is set at a height of 1.65 m (5.5 feet) above floor level, within the enclosure, to represent an average machine operator height.

Each grinding experiment is conducted following the following cycles:

A. Start up: ambient air sampling (15 minutes)

B. Coolant spraying: idling (30 minutes), wherein recirculating coolant is sprayed on the revolving wheel/workpiece interface.

C. Purge work space with air (10 minutes)

D. Ambient air sampling (5 minutes)

E. Grinding (15 minutes) by machining the surface in incremental sweeps of 25 μm (0.001").

F. Purge work space with air (10 minutes)

G. Ambient air sampling (5 minutes).

In a typical run, steps B through F are repeated two or three times (at about 1.5 hours per repetition) and the generated mist level is continuously monitored and recorded.

Example 1.

The measured antimist efficiency of a 5% soluble oil emulsion containing 500 parts per million of rhamsan gum and conventional amounts of other additives typical for metalworking soluble oil emulsions, compared to a corresponding 5% soluble oil emulsion without the rhamsan gum additive as a baseline, is measured and reported as a percent mist suppression. After a total elapsed grinding time of 0.75 hours, the test composition exhibits a mist suppression of 53.5%. After an elapsed grinding time of 3.25 hours, the mist suppression remains 48.3%.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade.

However, the amount of each chemical component is presented exclusive of any solvent or diluent oil which may be customarily present in the commercial material, unless otherwise indicated. It is to be understood that the upper and lower amount, range, and ratio limits set forth herein may be independently combined. As used herein, the expression "consisting essentially of" permits the inclusion of substances which do not materially affect the basic and novel characteristics of the composition under consideration.

What is claimed is:

1. A method for lubricating a workpiece in an operation which is susceptible to formation of lubricant mist, comprising: supplying to said workpiece a lubricating composition comprising (a) water and (b) a water-soluble heteropolysaccharide having a tetrasaccharide repeating unit which contains a carboxylic group and a saccharide substituent at carbon 6 of each 3-linked backbone glucose, in an amount suitable to reduce mist formation from said composition.

2. A method for lubricating a workpiece in an operation which is susceptible to formation of lubricant mist, comprising: supplying to said workpiece a lubricating composition comprising (a) water and (b) an amount of rhamsan gum suitable to reduce mist formation from said composition.

3. A method for reducing mist formation in a high shear aqueous system which involves application of an aqueous lubricating composition in said high shear system, comprising: including in said aqueous composition a mist reducing amount of rhamsan gum.

4. The method of claim 2 wherein the workpiece is a metal piece.

5. The method of claim 2 wherein the operation is a metal cutting or a metal forming operation.

6. The method of claim 2 wherein the amount of rhamsan gum is about 50 to about 5,000 parts per million by weight of the lubricating composition.

7. The method of claim 2 wherein the amount of rhamsan gum is about 200 to about 1000 parts per million by weight of the lubricating composition.

8. The method of claim 2 wherein the lubricating composition further comprises an emulsified oil phase.

9. The method of claim 8 wherein the oil phase comprises mineral oil.

10. The method of claim 8 wherein the oil phase comprises an animal oil or a vegetable oil.

11. The method of claim 8 wherein the oil phase comprises a synthetic oil.

12. The method of claim 8 wherein the ratio of oil to water is about 1:1 to about 1:400 by weight.

13. The method of claim 8 wherein the ratio of oil to water is about 1:2 to about 1:200 by weight.

14. The method of claim 8 wherein the ratio of oil to water is about 1:9 to about 1:50 by weight.

15. The method of claim 8 wherein the lubricating composition further comprises an emulsifier.

16. The method of claim 2 wherein the lubricating composition further comprises a minor amount of at least one additive selected from the group consisting of rust inhibitors, corrosion inhibitors, defoamers, alkaline agents, lubricity agents, and preservatives.

17. The method of claim 2 wherein the lubricating composition further comprises a plasticizer for the rhamsan gum.

18. The method of claim 17 wherein the plasticizer is an alkylene glycol.

19. The method of claim 18 wherein the alkylene glycol is ethylene glycol.

20. The method of claim 2 wherein the lubricating composition further comprises a coupling agent in an amount sufficient to improve the compatibility of the rhamsan gum with the water.

21. The method of claim 5 wherein the cutting operation imparts a shear to the lubricating composition of at least about 1,000 $sec^{-1}$.

22. The method of claim 21 wherein the shear is at least about 10,000 $sec^{-1}$.

23. The method of claim 21 wherein the shear is at least about 100,000 $sec^{-1}$.

* * * * *